US008203495B2

(12) United States Patent
Tonn

(10) Patent No.: US 8,203,495 B2
(45) Date of Patent: Jun. 19, 2012

(54) MODULAR VLF/LF AND HF BUOYANT CABLE ANTENNA AND METHOD

(75) Inventor: David A. Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 284 days.

(21) Appl. No.: 12/781,195

(22) Filed: May 17, 2010

(65) Prior Publication Data

US 2011/0279336 A1 Nov. 17, 2011

(51) Int. Cl.
*H01Q 1/34* (2006.01)

(52) U.S. Cl. ..... 343/709; 343/719

(58) Field of Classification Search ..... 343/709, 343/719, 710, 790, 791
See application file for complete search history.

(56) References Cited

U.S. PATENT DOCUMENTS

| | | | | |
|---|---|---|---|---|
| 4,760,348 | A * | 7/1988 | Pease et al. | 330/151 |
| 4,774,519 | A * | 9/1988 | Pease et al. | 343/709 |
| 5,933,117 | A * | 8/1999 | Gerhard | 343/709 |
| 7,868,833 | B2 * | 1/2011 | Tonn | 343/709 |

* cited by examiner

*Primary Examiner* — Hoanganh Le
(74) *Attorney, Agent, or Firm* — James M. Kasischke; Jean-Paul A. Nasser; Michael P. Stanley

(57) ABSTRACT

A buoyant cable antenna system includes an HF antenna section connected to an outboard end of a VLF/LF antenna. With respect to the HF antenna, the VLF/LF appears to be a standard coaxial cable so that the HF antenna can be configured as desired for HF antenna operation. The VLF/LF antenna is comprised of a segment of coaxial cable. The inboard end of the braided outer conductor of the segment of coaxial cable is connected to ground through a capacitor so that the VLF/LF signals are effectively isolated from ground. In this way, VLF/LF currents are induced on the outer braided conductor of the segment of coaxial cable to thereby operate as the VLF/LF antenna.

12 Claims, 2 Drawing Sheets

MODULAR VLF/LF AND HF BUOYANT CABLE ANTENNA AND METHOD

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION

1. Field of the Invention

The present invention relates generally to buoyant cable antennas and, more particularly, to a buoyant cable antenna with an antenna module for VLF/LF (Very Low Frequency/Low Frequency) bands and another antenna module for HF (High Frequency) band performance.

2. Description of the Prior Art

The buoyant cable antenna is one of a host of submarine antennas currently in use for communications. The buoyant cable antenna is utilized while the submarine is submerged. The legacy antenna in current use represents a compromise between VLF/LF performance and high frequency (HF) performance. The HF performance is, in fact, compromised by the need for a single antenna element to provide coverage at the HF and VLF/LF bands.

The following U.S. patents describe various prior art systems telemetry systems:

U.S. Pat. No. 4,476,576, issued Oct. 9, 1984, to Wheeler et al, discloses a VLF communication system which utilizes the electrically conducting portions of an electromechanical cable connected to a deployed aerostat which acts as its tether so as to additionally serve as the VLF antenna.

U.S. Pat. No. 4,760,348 and U.S. Pat. No. 4,774,519, issued Jul. 26, 1988 and Sep. 27, 1988, respectively, to Pease et. al., disclose a towable broadband submarine antenna system for deployment in the ocean operation, which comprises an antenna element including a metallic termination tip and a length of single conductor buoyant cable. A broadband amplifier connects to the antenna element and provides separate paths for the VLF/LF and the HF/VHF signals with amplification provided only to the HF/VHF signals. The signal from the broadband amplifier is further transmitted on a coaxial cable.

U.S. Pat. No. 5,252,984, issued Oct. 12, 1993, to Dorrie et al, discloses an elongated rod of dielectric material, for example fiberglass—plastic or the like, which has a central conductor located coaxially therein. The insulating rod is surrounded by a conductive layer, for example conductive lacquer, a mesh or braid of conductive material, a conductive foil or tube or the like. The bottom terminal of the central conductor will provide a high resistance output for the higher one of the frequency ranges which, for example, can be a radio telephone, or vehicular communication frequency of between 450-470 MHz. The entire antenna is suitable as an AM-FM/radio-telephone combination antenna. Preferably, the antenna is covered with a sleeve of insulating material, for example a heat shrinkable plastic. The band width of the antenna can be extended by placing a further electrically conductive layer on the rod, spaced by a gap (a) physically and electrically from the conductive layer in the middle of the elongated rod. The further conductive layer is connected to the inner coaxial conductor, which in turn can be coupled to an antenna input, for example the center conductor of a coaxial cable of a radio apparatus.

U.S. Pat. No. 5,606,329, issued Feb. 25, 1997, to Ramotowski et al, discloses a submarine buoyant cable antenna having positive buoyancy comprising a communications antenna electronics package encased in a polymer composition, the polymer composition comprising from about 80 percent to about 85 percent by weight of a room temperature curable thermosetting polymer having a viscosity, before curing, in the range of from about 700 to about 900 centipoise, and from about 15 percent to about 20 percent by weight of microballoons of a size ranging from about 20 to about 100 microns in diameter, the specific gravity of the composition being in the range of from about 0.51 to about 0.65 grams per cubic centimeter to provide the positive buoyancy.

U.S. Pat. No. 6,864,842, issued Mar. 8, 2005, to Hung et al, discloses a tri-band antenna that includes an insulative planar base, a low-frequency radiating portion, a high-frequency radiating portion, a first ground portion and a signal feeder cable. A resonating lacuna is defined between the first radiating portion and the first ground portion. The signal feeder cable includes an inner core wire and a metal braiding layer respectively soldered onto the connecting point of the low-frequency radiating portion and the high-frequency radiating portion and the first ground portion.

The above cited prior art does not disclose a modular buoyant cable antenna element suitable for submarine communications which provides the ability to optimize reception of signals in the very low frequency (VLF) and low frequency (LF) radio bands from 10 kHz-200 kHz as well as high frequency (HF) radio bands.

SUMMARY OF THE INVENTION

An object of the present invention is to provide an improved multi-frequency band capability for a buoyant cable system.

Another possible object of the present invention is to provide a modular antenna in which one section handles the VLF/LF portion of the band, while the remaining portion can be optimized for HF performance.

An advantage of the present invention is a modular antenna design, which allows for a variety of HF (or even VHF) antenna tips to be utilized while still providing the VLF/LF capability that the submarine requires.

Accordingly, the present invention provides a buoyant cable antenna system for use by a submerged submarine. The antenna system may, in one possible embodiment, comprise a coaxial line segment with a center conductor and a braided outer conductor.

The first coaxial line segment has an inboard end closest to the submarine and an outboard end furthest from the submarine. An HF antenna is electrically connected to the outboard end of the coaxial line segment. The braided outer conductor acts as a VLF/LF antenna. However, the coaxial line segment acts as standard coaxial cable for HF signals. Both the HF antenna and the VLF/LF antenna are buoyant to float on the surface of the water when deployed.

A filter is connected to the inboard end of the coaxial line segment. The filter may comprise a first capacitor connected between ground and the braided outer conductor whereby VLF/LF signals are induced on the braided outer conductor. In this way, the braided outer conductor acts as the VLF/LF antenna.

The filter may comprise a second capacitor connected to the inboard end of the center conductor of the coaxial line segment to conduct HF signals. The second capacitor directs an HF signal from the HF antenna to the submarine. The filter may comprise an inductor connected between the first capacitor and the braided outer conductor, whereby the inductor directs a VLF/LF signal from the VLF/LF antenna to the submarine.

In one embodiment, the second capacitor and the inductor are connected to an antenna feed point.

The HF signal from the HF antenna may be connected to the outboard end of the center conductor of the coaxial line segment. The outboard end of the braided conductor may be connected directly to ground.

In one embodiment, the coaxial line segment may have a length between 50 and 200 feet. Because the coaxial line segment appears as a standard coaxial cable to the HF antenna, the HF antenna is selectively changeable independently of the VLF/LF antenna.

In another embodiment of the invention, a method is provided for making a buoyant cable antenna system. The method may comprise steps such as providing a coaxial line segment with a center conductor and a braided outer conductor. The coaxial line segment has an inboard end closest to the submarine and an outboard end furthest from the submarine.

The invention may comprise electrically connecting an HF antenna to the outboard end of the coaxial line segment and connecting a filter to an inboard end of the coaxial line segment.

The filter may comprise a first capacitor connected between ground and the braided outer conductor whereby VLF/LF signals are induced on the braided outer conductor. In this way, the braided outer conductor acts as a VLF/LF antenna.

In accord with the method, the filter may comprise a second capacitor connected to the center conductor of the coaxial line segment. The filter may further comprise an inductor connected between the first capacitor and the braided outer conductor whereby the second capacitor directs an HF signal from the HF antenna to the submarine and the inductor directs a VLF/LF signal from the VLF/LF antenna to the submarine.

The method may further comprise connecting the second capacitor and the inductor to an antenna feed point and/or connecting the HF signal from the HF antenna to an outboard end of the center conductor of the coaxial line segment.

In one possible embodiment, the method may further comprise connecting an outboard end of the braided conductor directly to ground. The method may further comprise providing that the coaxial line segment has a length between 50 and 200 feet. The method may further comprise selectively changing a type of the HF antenna independently of the VLF/LF antenna.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION OF THE INVENTION

Figure 1:
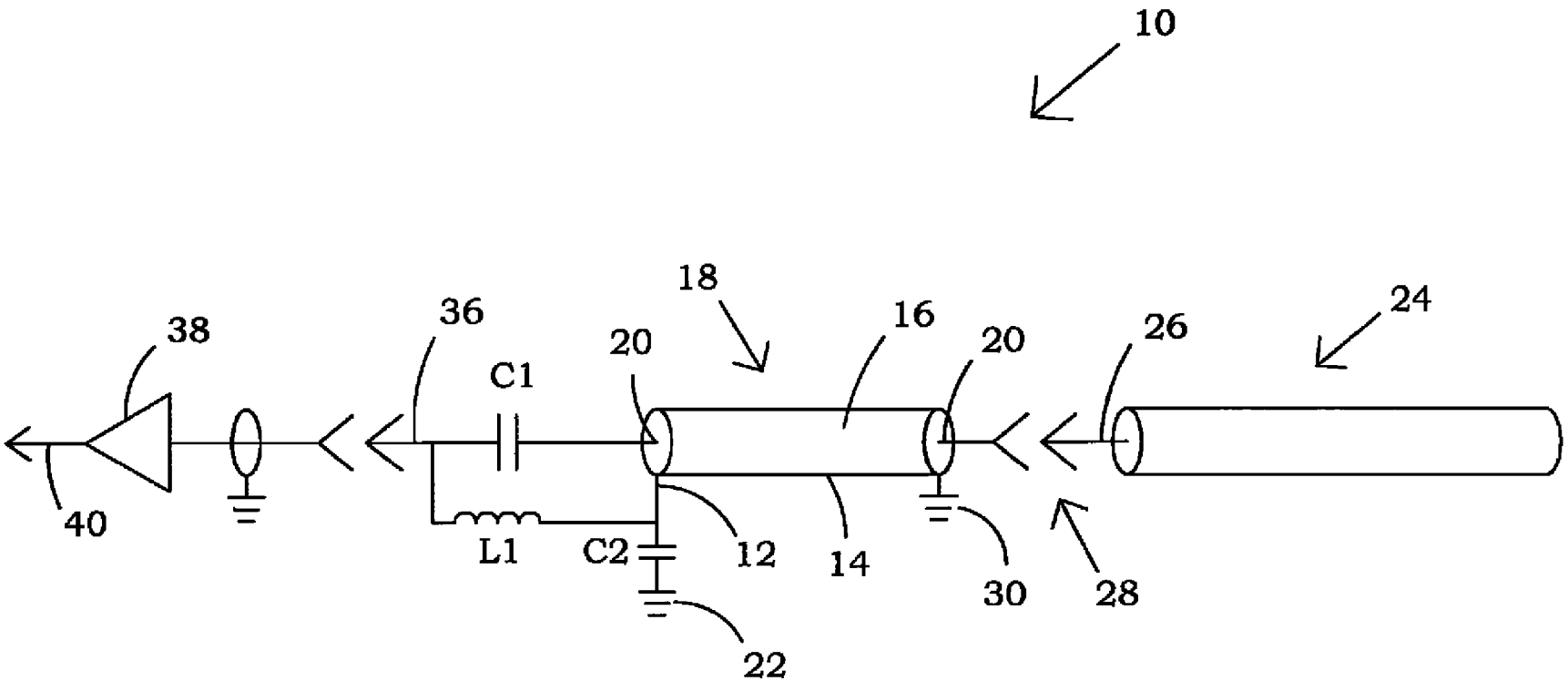
FIG. 1 is an electronic schematic diagram which shows a VLF/LF antenna module and an HF antenna module and signal routing circuitry in accord with one possible embodiment of the present invention.

Referring now to the drawings and in particular to FIG. 1, there is shown an electronic schematic diagram of an embodiment of buoyant cable antenna system 10 in accord with the present invention. It will be noted that connection 12 is made to the inboard side of braided outer conductor 14 of coaxial line segment 16. As discussed hereinafter, braided outer conductor 14 acts as VLF/LF antenna 18 in accord with the present invention. The HF antenna 24 and VLF/LF antenna 18 are sufficiently buoyant to float on the surface of the water when the submarine is submerged.

Normally, unbalanced currents are avoided in antenna system designs. An unbalanced current can occur when an antenna (or amplifier or other RF device) is connected to an unbalanced transmission line. An example of an unbalanced transmission line is the familiar coaxial line without the use of a balun or some form of surface current suppression, such as ferrite beads.

Contrary to standard practice in the prior art, the present invention works by making use of unbalanced currents. The unbalanced current consists of a current density flowing on the outer surface of braid 14 on coaxial line segment 16. Such current is normally considered undesirable since this current can contribute to unwanted signal radiation and interference.

In the present invention, an unbalanced surface current is deliberately allowed to form. This is done in order to allow braid 14 on coaxial line segment 16 to act like an antenna. To limit the range of frequencies over which this effect takes place, a filter circuit is used. The filter circuit may comprise circuit components such as capacitors C1 and C2 as well as inductor L1. Other circuit components or combinations of components may be utilized which generally perform the functions described below.

The filter allows coaxial line segment 16 to act like an antenna 18 for the VLF/LF bands, and as an ordinary piece of coaxial line at HF and higher bands. Signals from the antennas may be amplified using amplifier 38, which may then be connected to the remainder of the buoyant cable 40, which may be in the range of about 1900 feet long.

Capacitor C1 blocks the flow of VLF/LF currents from center conductor 20 of coaxial line segment 16. Coaxial line segment 16 may comprise the series of coaxial cable RG-384. C1 forces the VLF/LF current onto braid 14 of the coaxial line segment 16 through choke L1. This choke is present to prevent the flow of HF and higher frequency currents onto braid 14, forcing such currents to flow through C1 and down center conductor 20 of coaxial line segment 16.

Capacitor C2 floats ground 22 on the inboard side of coaxial line segment 16 and allows the VLF/LF current to avoid being "shorted out" while at the same time providing a low-impedance path for current flow to ground for any HF or higher frequency current components that may be induced to flow on braid 14. Ground 30 on the outboard side of coaxial line segment 16 may be connected directly to braid 14.

HF antenna 24 shown in the figure is an enhanced buoyant cable element. In another embodiment, HF antenna 24 could be a vertical antenna element, a spoke wheel antenna element, or any other HF or VHF capable antenna. As discussed above, the filter circuit just described allows VLF/LF antenna 18 to look like an ordinary piece of coaxial line at HF and higher frequencies. Accordingly, HF signals on center conductor 26 of HF antenna 24 may be connected through coaxial connector 28 to center conductor 20 of the outboard side of coaxial line segment 16.

One possible example of a working model of antenna system 10 comprises 110 ft. of RG-384 transmission line to act as VLF/LF antenna 18. In this example of the filter circuit, L1 is chosen to be 3 microhenries, C1=0.1 microfarads, and C2=0.01 microfarads. The filter circuit was molded into the jacket of the antenna to protect it from water intrusion.

During testing of this model, an enhanced HF antenna 24 was used. As discussed above, the present invention allows the HF antenna to be specifically adapted for HF band operation without concern about VLF/LF band operation.

Figure 2:
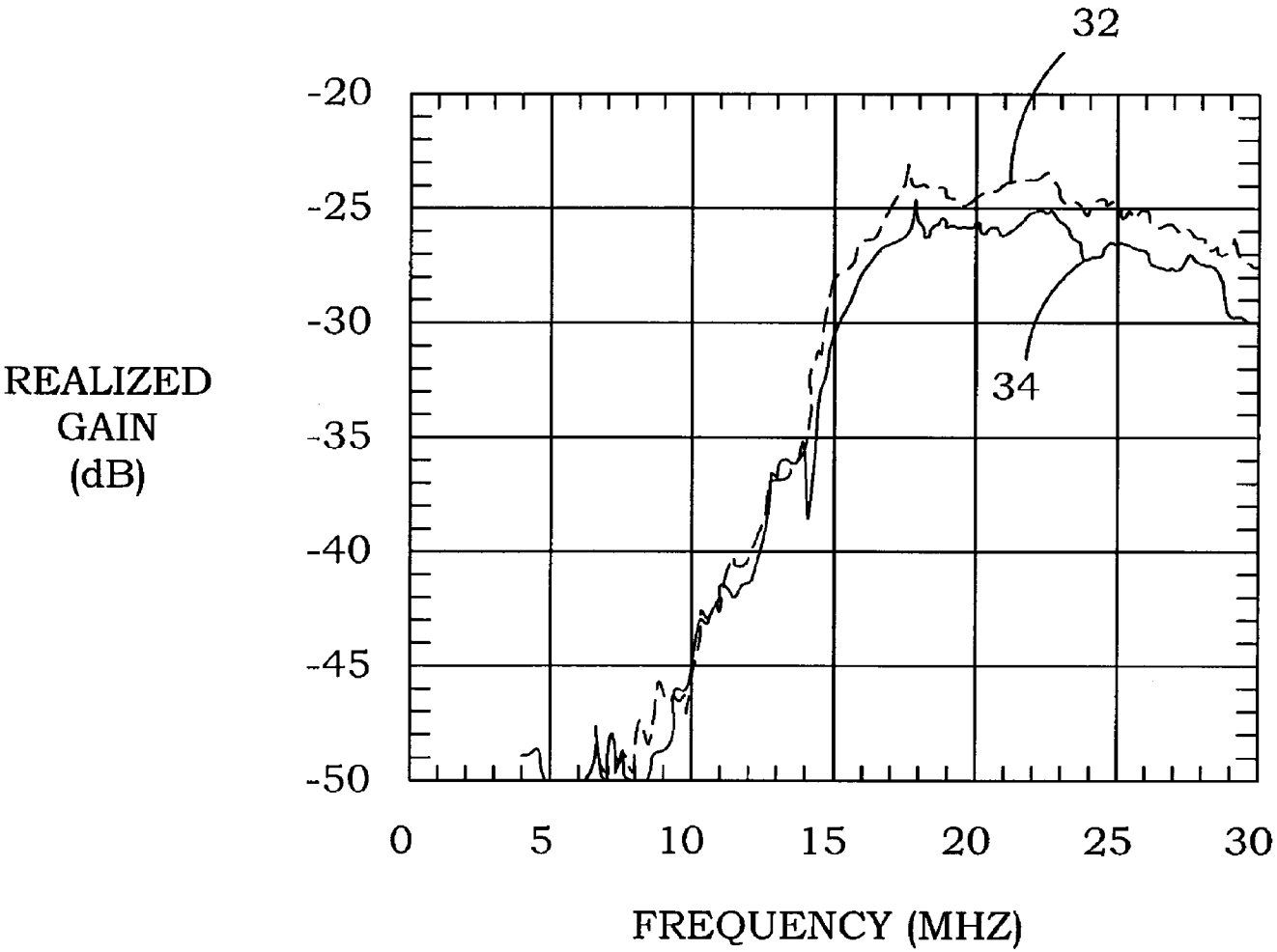
FIG. 2 is a graph of the response of one possible HF antenna when the HF antenna is utilized by itself as compared to when the HF antenna is connected to the VLF/LF antenna of the embodiment of the present invention.

FIG. 2 shows the measured HF gain performance 34 of HF antenna 24 connected to VLF/LF antenna 18 compared with the performance 32 of HF antenna 24 by itself. As expected, the gain profile of HF antenna 24 connected to VLF/LF antenna 18 tracks that of HF antenna 24 by itself, but is reduced slightly by the attenuation in the 110 ft. worth of coaxial line segment 16 which is between HF antenna 24 and feed point 36 of antenna system 10.

In terms of VLF performance, a spot measurement was performed using the U.S. Navy broadcast station at Cutler, Me. (NAA, f=24.0 kHz) as a beacon. The power received by the invention antenna was compared with that received by a loop antenna mounted nearby. The power received by the loop was −90.5 dBm; the power received by the invention was −57.5 dBm. Knowing that the effective height of the loop is 0.79 mm, and accounting for the difference in antenna impedances and orientation, the measured effective height of the present invention is 31 mm. This represents a substantial improvement over the loop and slightly better than the legacy VLF buoyant cable (20 mm).

Other values of components may be utilized depending on the frequencies, types of HF antenna 24, and the like. As well, the length for coaxial line segment 16 may vary and may typically be in a range from 50 feet to 200 feet. However, the length may also be greater than or less than this range, if desired.

Accordingly, in one embodiment of operation, HF antenna 24 is connected to VLF/LF antenna 18 as though connecting to a standard coaxial cable. VLF/LF current is induced on braid 14 so that braid 14 on coaxial line segment 16 acts as a VLF/LF antenna. The filter components C1, L1, and C2 direct HF signals through center conductor 20 of coaxial line segment 16, and VLF/LF signals off of braid 14 of coaxial line segment 16 to feed point 36 of antenna system 10. In this way, the present invention provides essentially independent VLF/LF and HF antenna modules for a buoyant cable antenna system.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A buoyant cable antenna system for use by a submerged submarine, comprising:

a coaxial line segment comprising a center conductor and a braided outer conductor, said coaxial line segment having an inboard end closest to said submarine and an outboard end furthest from said submarine;

an HF antenna electrically connected to said outboard end of said coaxial line segment; and a filter connected to an inboard end of said coaxial line segment, said filter comprising a first capacitor connected between ground and said braided outer conductor, whereby VLF/LF signals are induced on said braided outer conductor such that said braided outer conductor acts as a VLF/LF antenna, said filter comprising a second capacitor connected to said center conductor of said coaxial line segment, said filter comprising an inductor connected between said first capacitor and said braided outer conductor, whereby said second capacitor directs an HF signal from said HF antenna to said submarine, and said inductor directs a VLF/LF signal from said VLF/LF antenna to said submarine.

2. The buoyant cable antenna system of claim 1, wherein said second capacitor and said inductor are connected to an antenna feed point.

3. The buoyant cable antenna system of claim 1, wherein said HF signal from said HF antenna is connected to an outboard end of said center conductor of said coaxial line segment.

4. The buoyant cable antenna system of claim 1, wherein an outboard end of said braided outer conductor is connected directly to ground.

5. The buoyant cable antenna system of claim 1, wherein said coaxial line segment has a length between 50 and 200 feet.

6. The buoyant cable antenna system of claim 1, wherein said HF antenna is selectively changeable independently of changes to said VLF/LF antenna.

7. A method for making a buoyant cable antenna system for use by a submerged submarine, comprising:

providing a coaxial line segment comprising a center conductor and a braided outer conductor wherein said first coaxial line segment has an inboard end closest to said submarine and an outboard end furthest from said submarine;

electrically connecting an HF antenna to said outboard end of said coaxial line segment; and connecting a filter to an inboard end of said coaxial line segment, said filter comprising a first capacitor connected between ground and said braided outer conductor, whereby VLF/LF signals are induced on said braided outer conductor such that said braided outer conductor acts as a VLF/LF antenna, said filter comprising a second capacitor connected to said center conductor of said coaxial line segment, said filter comprising an inductor connected between said first capacitor and said braided outer conductor, whereby said second capacitor directs an HF signal from said HF antenna to said submarine and said inductor directs a VLF/LF signal from said VLF/LF antenna to said submarine.

8. The method of claim 7, further comprising connecting said second capacitor and said inductor to an antenna feed point.

9. The method of claim 7, further comprising connecting said HF signal from said HF antenna to an outboard end of said center conductor of said coaxial line segment.

10. The method of claim 7, further comprising connecting an outboard end of said braided outer conductor directly to ground.

11. The method of claim 7, further comprising providing that said coaxial line segment has a length between 50 and 200 feet.

12. The method of claim 7, further comprising selectively changing a type of said HF antenna independently of changing said VLF/LF antenna.

* * * * *